US007278497B2

(12) United States Patent
Terry et al.

(10) Patent No.: US 7,278,497 B2
(45) Date of Patent: Oct. 9, 2007

(54) METHOD FOR EXTRACTING COAL BED METHANE WITH SOURCE FLUID INJECTION

(75) Inventors: Jim Terry, Houston, TX (US); Tom Bailey, Houston, TX (US); Adrian Vuyk, Houston, TX (US); Alejandro Coy, Katy, TX (US); Ron Divine, Humble, TX (US); Darrell Johnson, Katy, TX (US)

(73) Assignee: Weatherford/Lamb, Houston, TX (US)

( * ) Notice: Subject to any disclaimer, the term of this patent is extended or adjusted under 35 U.S.C. 154(b) by 254 days.

(21) Appl. No.: 10/888,558

(22) Filed: Jul. 9, 2004

(65) Prior Publication Data

US 2006/0006004 A1 Jan. 12, 2006

(51) Int. Cl.
*E21B 7/04* (2006.01)

(52) U.S. Cl. ..... 175/61; 175/70

(58) Field of Classification Search ..... None
See application file for complete search history.

(56) References Cited

U.S. PATENT DOCUMENTS

| | | | | |
|---|---|---|---|---|
| 4,043,132 | A | 8/1977 | Zupanick | |
| 4,991,668 | A * | 2/1991 | Rehm et al. | 175/61 |
| 5,115,872 | A | 5/1992 | Brunet et al. | |
| 5,394,950 | A | 3/1995 | Gardes | |
| 5,462,120 | A | 10/1995 | Gondouin | |
| 5,720,356 | A | 2/1998 | Gardes | |
| 6,065,550 | A | 5/2000 | Gardes | |
| 6,280,000 | B1 | 8/2001 | Zupanick | |
| 6,357,523 | B1 | 3/2002 | Zupanick | |
| 6,439,320 | B2 | 8/2002 | Zupanick | |
| 6,478,085 | B2 | 11/2002 | Zupanick | |

(Continued)

FOREIGN PATENT DOCUMENTS

| | | |
|---|---|---|
| WO | WO99/42696 | 8/1999 |

(Continued)

OTHER PUBLICATIONS

Gardes Energy Services, Inc., Video Clip (on CD-Rom), Date Unknown.

(Continued)

*Primary Examiner*—Frank Tsay
(74) *Attorney, Agent, or Firm*—Patterson & Sheridan, L.L.P.

(57) ABSTRACT

The present invention generally provides an inexpensive method for drilling a multilateral wellbore where the pressure exerted on a formation of interest by a column of drilling fluid may be controlled. In one aspect, a method for drilling a lateral wellbore from a main wellbore is provided, including running a string of casing with an injection line connected thereto into the main wellbore, wherein the injection line is disposed along an outer side of the casing and a portion of the casing corresponding to a starting depth of the lateral wellbore is made from a drillable material; running a drillstring through the casing to the starting depth of the lateral wellbore, wherein the drillstring comprises a drill bit; injecting drilling fluid through the drill sting; and injecting a second fluid, having a density less than that of the drilling fluid, through the injection line at a rate corresponding to an injection rate of the drilling fluid to control hydrostatic pressure exerted by a column of the drilling fluid and the second fluid returning through the casing.

55 Claims, 5 Drawing Sheets

U.S. PATENT DOCUMENTS

| | | | | |
|---|---|---|---|---|
| 6,561,288 | B2 | 5/2003 | Zupanick | |
| 6,598,686 | B1 | 7/2003 | Zupanick | |
| 6,607,042 | B2 | 8/2003 | Hoyer et al. | |
| 6,668,918 | B2 | 12/2003 | Zupanick | |
| 6,679,322 | B1 | 1/2004 | Zupanick | |
| 6,688,388 | B2 | 2/2004 | Zupanick | |
| 6,725,922 | B2 | 4/2004 | Zupanick | |
| 6,732,792 | B2 | 5/2004 | Zupanick | |
| 6,745,855 | B2 | 6/2004 | Gardes | |
| 6,899,186 | B2 | 5/2005 | Galloway et al. | |
| 6,964,308 | B1 | 11/2005 | Zupanick | |
| 6,976,533 | B2 | 12/2005 | Zupanick | |
| 6,991,047 | B2 | 1/2006 | Zupanick | |
| 6,991,048 | B2 * | 1/2006 | Zupanick | 175/61 |
| 7,025,154 | B2 | 4/2006 | Zupanick | |
| 7,073,595 | B2 | 7/2006 | Zupanick et al. | |
| 2001/0010432 | A1 | 8/2001 | Zupanick | |
| 2004/0035582 | A1 | 2/2004 | Zupanick | |
| 2004/0149432 | A1 | 8/2004 | Zupanick | |
| 2004/0206493 | A1 | 10/2004 | Zupanick et al. | |
| 2004/0244974 | A1 | 12/2004 | Zupanick et al. | |
| 2005/0045340 | A1 | 3/2005 | Hewson et al. | |
| 2005/0087340 | A1 | 4/2005 | Zupanick et al. | |
| 2005/0257962 | A1 | 11/2005 | Zupanick | |
| 2006/0096755 | A1 | 5/2006 | Zupanick | |

FOREIGN PATENT DOCUMENTS

| | | |
|---|---|---|
| WO | WO 03/102348 | 12/2003 |

OTHER PUBLICATIONS

"The Need for a Viable Multi-Seam Completion Technology for the Powder River Basin", Gardes Energy Services, Inc. Date Unknown.

U.K. Search Report, Application No. GB0513826.8, dated Aug. 12, 2005.

* cited by examiner

METHOD FOR EXTRACTING COAL BED METHANE WITH SOURCE FLUID INJECTION

BACKGROUND OF THE INVENTION

1. Field of the Invention

Embodiments of the present invention generally relate to methods for extracting coal bed methane with source fluid injection. Specifically, methods are provided for forming one or more laterals off a main wellbore using an approach that is economical and does not substantially damage the formation.

2. Description of the Related Art

A common method of drilling wells from the surface through underground formations employs the use of a drill bit that is rotated by means of a downhole motor (sometimes referred to as a mud motor), through rotation of a drill string from the surface, or through a combination of both surface and downhole drive means. Where a downhole motor is utilized, typically energy is transferred from the surface to the downhole motor through pumping a drilling fluid or "mud" down through a drill string and channeling the fluid through the motor in order to cause the rotor of the downhole motor to rotate and drive the rotary drill bit. The drilling fluid or mud serves the further function of entraining drill cuttings and circulating them to the surface for removal from the wellbore. In some instances the drilling fluid may also help to lubricate and cool the downhole drilling components.

When drilling for oil and gas there are many instances where the underground formations that are encountered contain hydrocarbons that are subjected to very high pressures. Traditionally, when drilling into such formations a high density drilling fluid or mud is utilized in order to provide a high hydrostatic pressure within the wellbore to counteract the high pressure of the hydrocarbons in the formation below. In such cases the high density of the column of drilling mud exerts a hydrostatic pressure upon the below ground formation that meets or exceeds the underground hydrocarbon pressure thereby preventing a potential blowout which may otherwise occur. Where the hydrostatic pressure of the drilling mud is approximately the same as the underground hydrocarbon pressure, a state of balanced drilling is achieved. However, due to the potential danger of a blowout in high pressure wells, in most instances an overbalanced situation is desired where the hydrostatic head of the drilling mud exceeds the underground hydrocarbon pressure by a predetermined safety factor. The high density mud and the high hydrostatic head that it creates also helps prevent a blowout in the event that a sudden fluid influx or "kick" is experienced when drilling through a particular aspect of an underground formation that is under very high pressure, or when first entering a high pressure zone.

Unfortunately, such prior systems that employ high density drilling muds to counterbalance the effects of high pressure underground hydrocarbon deposits have met with only limited success. In order to create a sufficient hydrostatic head in many instances the density of the drilling muds has to be relatively high (for example from 15 to 25 pounds per gallon) necessitating the use of costly density enhancing additives. Such additives not only significantly increase the cost of the drilling operations, but can also present environmental difficulties in terms of their handling and disposal. High density muds are also generally not compatible with many 4-phase surface separation systems that are designed to separate gases, liquids and solids. In typical surface separation systems, the high density solids are removed preferentially to the drilled solids and the mud must be re-weighted to ensure that the desired density is maintained before it can be pumped back into the well.

High density drilling muds also present an increased potential for plugging downhole components, particularly where the drilling operation is unintentionally suspended due to mechanical failure. Further, the expense associated with costly high density muds is often increased through their loss into the underground formation. Often the high hydrostatic pressure created by the column of drilling mud in the string results in a portion of the mud being driven into the formation requiring additional fresh mud to be continually added at the surface. Invasion of the drilling mud into the subsurface formation may also cause damage to the formation.

A further limitation of such prior systems involves the degree and level of control that may be exercised over the well. The hydrostatic pressure applied to the bottom of the wellbore is primarily a function of the density of the mud and the depth of the well. For that reason there is only a limited ability to alter the hydrostatic pressure applied to the formation when using high density drilling muds. Generally, varying the hydrostatic pressure requires an alteration of either the density of the drilling mud or the surface back-pressure, both of which can be a difficult and time consuming process.

Therefore, there has been developed the technique that is called underbalanced or managed pressure drilling, which technique allows for greater production, and does not create formational damage which would impede the production process. Furthermore, it has been shown that productivity is enhanced in multilateral wells combined with the non-formation damaging affects of the underbalanced or managed pressure drilling. In this technique, a predetermined differential pressure is maintained between the pressure exerted on the formation by the column of drill fluid (plus back pressure) and a characteristic formation pressure, i.e., pore pressure or fracture pressure. There is some disagreement among those skilled in the art over the distinction between managed pressure and underbalanced drilling. Some would define managed pressure drilling as a species or sub-set of underbalanced drilling where it is often preferable to maintain the pressure exerted on the formation at some value between the fracture pressure and pore pressure of the formation. Others would define the terms in opposite fashion where underbalanced is a species or sub-set of managed pressure drilling.

The underbalanced or managed pressure technique is accomplished by introducing a lighter fluid such as nitrogen or air into the drill hole, or a combination of same or other type fluids or gases, sufficiently as manage the pressure on the formation so that fluid in the borehole does not move into the formation during drilling. One technique of underbalanced or managed pressure drilling is referred to as micro-annulus drilling where a low pressure reservoir is drilled with an aerated fluid in a closed system. In effect, a string of casing is lowered into the wellbore and utilizing a two string drilling technique, there is circulated a lighter fluid down the outer annulus, which lowers the hydrostatic pressure of the fluid inside the column, thus relieving the formation. This allows the fluid to be substantially equal to or lighter than the formation pressure which, if it weren't, would cause everything to flow into the wellbore which is detrimental. By utilizing this system, drillers are able to circulate a lighter fluid which can return up either the inner or outer annulus, which enables them to circulate with a different fluid down the drill string. In doing so, basically air and/or nitrogen are being introduced down the system which allows them to circulate two different combination fluids with two different strings.

Drilling for coal bed methane presents different conditions than drilling for oil and gas. If oil is used for drilling into the formations, the fluids may clog the permeations through the coal damaging the formation. A typical coal bed methane formation takes much longer to produce from than does an oil and gas formation. The formations must be dewatered and then the methane must separate from the coal before entering the wellbore. Uncontrolled overbalanced drilling with water would just add to the dewatering work and could possibly damage the formation. The returns from a coal bed methane formation are steady as compared to the exponential returns from an oil and gas formation. Returns from a single formation may be small relative to an oil and gas formation. Using conventional drilling and completion methods may call for ignoring smaller formations. Thus, inexpensive drilling and completion methods are advantageous. Many of the known formations are in environmentally sensitive areas making the option of drilling several conventional wells disadvantageous. Thus, for a well to be economically and environmentally viable, drilling several laterals from a single vertical or horizontal main wellbore is preferred. Coal bed methane formations are typically closer to the surface than oil and gas formations. This characteristic combined with lower reservoir pressures and a non-erosive nature compared to oil and gas wells presents the option of using drillable casing for lining all or sections of the wellbore.

Thus, there exists in the art a need for an inexpensive method for drilling a multilateral wellbore where the pressure exerted on a formation of interest by a column of drilling fluid may be controlled.

SUMMARY OF THE INVENTION

The present invention generally provides an inexpensive method for drilling a multilateral wellbore where the pressure exerted on a formation of interest by a column of drilling fluid may be controlled.

In one aspect a method for drilling a lateral wellbore from a main wellbore is provided, comprising running a string of casing with an injection line connected thereto into the main wellbore, wherein the injection line is disposed along an outer side of the casing and a portion of the casing corresponding to a starting depth of the lateral wellbore is made from a drillable material; running a drillstring through the casing to the starting depth of the lateral wellbore, wherein the drillstring comprises a drill bit; injecting drilling fluid through the drill sting; and injecting a second fluid, having a density less than that of the drilling fluid, through the injection line at a rate corresponding to an injection rate of the drilling fluid to control hydrostatic pressure exerted by a column of the drilling fluid and the second fluid returning through the casing.

Optionally, a drillable plug is disposed in the casing either at the surface or in the wellbore. The drillable plug may have a pilot hole therethrough. The drillable plug is supported by a diffuser shoe connected to the casing. The injection line is connected to the casing either at the diffuser shoe or at a port on an outer side of the casing. The length of the plug is configured so that a top side of the plug corresponds to the starting depth of the lateral to be drilled. Once the lateral has been drilled, the plug can be drilled down to a starting depth of a second lateral to be drilled. The process may be repeated for any number of desired laterals.

Optionally, a packer, a deflector stem, and a deflector device are run in through the main wellbore on a workstring to a location below the starting depth of the lateral. The packer is oriented and the length of the deflector stem configured so that the deflector device corresponds to the starting depth and orientation of the lateral and the packer is set. Once the lateral has been drilled, the deflector device and deflector stem are retrieved. The deflector stem is replaced by one whose length is configured so that the deflector device corresponds to a starting depth of a second lateral and re-seated in the packer. The process may be repeated for any number of desired laterals.

In a second aspect, a method for drilling a lateral wellbore from a main wellbore is provided, comprising running a string of casing into the main wellbore, wherein a portion of the casing corresponding to a starting depth of the lateral wellbore is made from a drillable material; running a drillstring through the casing to the starting depth of the lateral wellbore, wherein the drillstring comprises a drill bit; and injecting a drilling fluid and a second fluid, having a density less than that of the drilling fluid, through the drillstring, wherein an injection rate of the second fluid corresponds to an injection rate of the drilling fluid to control hydrostatic pressure exerted by a column of the drilling fluid and the second fluid returning through the casing.

Optionally, the main wellbore is drilled to the starting depth of the lateral wellbore. Further, any of the sub-aspects discussed with the first aspect may also be used with the second aspect.

In a third aspect, a method for drilling a lateral wellbore from a main wellbore is provided, comprising: a step for drilling the lateral wellbore from the main wellbore to a formation of interest; and a step for controlling hydrostatic head pressure exerted by a column of drilling fluid so as not to substantially damage the formation of interest.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
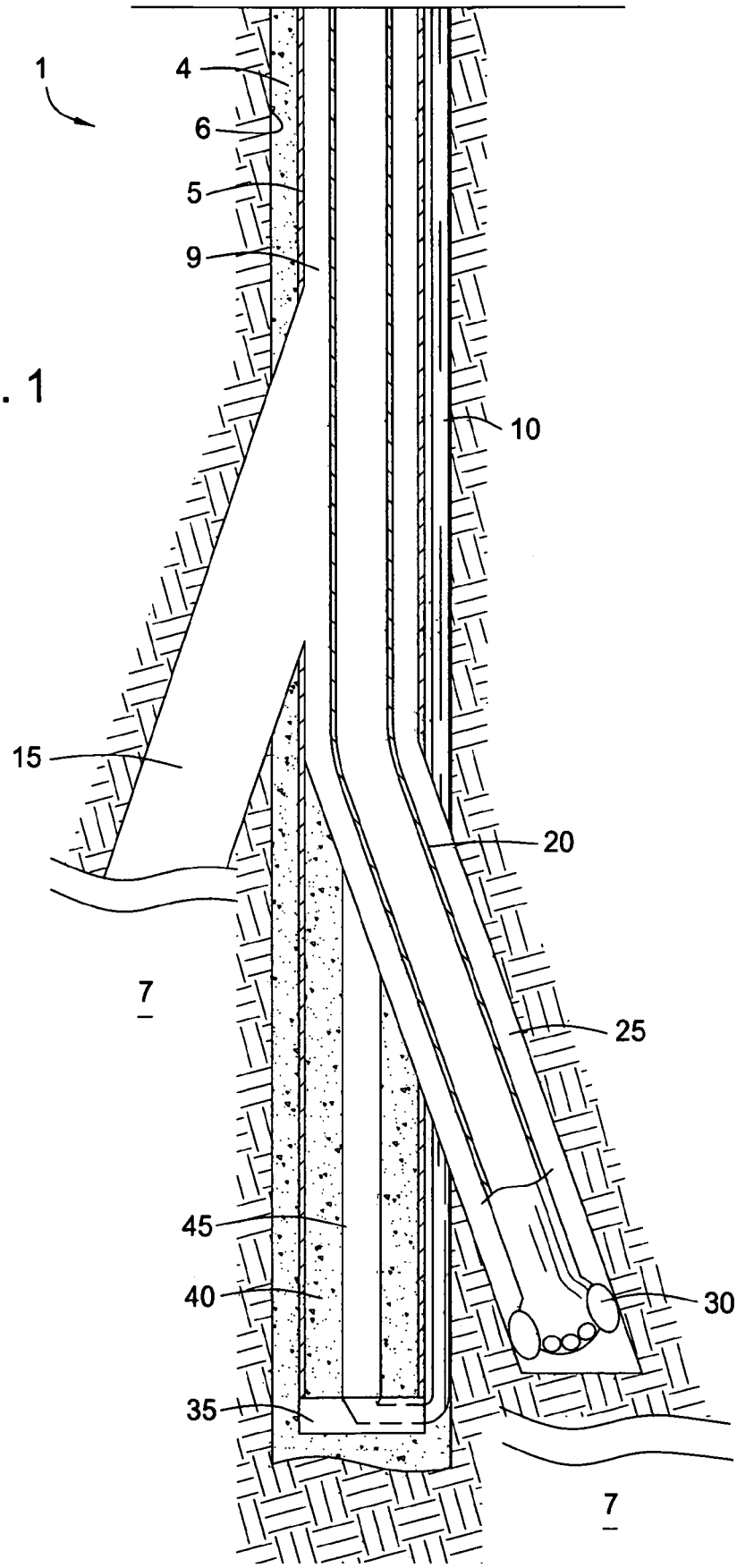
FIG. 1 is a sectional view of a multilateral well showing a portion of a drilled lateral wellbore and a second lateral wellbore in the process of being drilled with a drilling technique according to one aspect of the present invention.

In the description that follows, like parts are marked throughout the specification and drawings with the same reference numerals. FIG. 1 is a sectional view of a multilateral well 1 showing a portion of a drilled lateral wellbore 15 and a second lateral wellbore 25 in the process of being drilled with a drilling technique according to one aspect of the present invention. The well 1 shown in FIG. 1 may be created in the following manner. A main wellbore 6 is drilled from the surface (not shown) below a starting depth of the deepest planned lateral wellbore, in this case lateral 25. Numeral 7 represents a formation of interest. Preferably, the formation 7 is a coal bed methane formation. However, the formation 7 may be any hydrocarbon bearing formation.

In one sub-aspect, before run in of casing 5, a pre-formed drillable plug 40 is attached to a top side of a diffuser shoe 35, preferably, with a threaded connection (not shown). Alternatively, the plug 40 may just rest on the diffuser shoe 35. Preferably, the plug 40 is fiberglass with a pilot hole 45 therethrough. Initially, the length of the plug 40 corresponds to a starting depth of shallowest lateral to be drilled, in this case, lateral 15. The diffuser shoe 35 provides a fluid communication path between the injection line 10 and the pilot hole 45. The plug 40 is inserted into a bottom side of a string of casing 5 and the diffuser shoe 35 is attached to the bottom, preferably, with a threaded connection (not shown). Alternatively, the diffuser shoe 35 may be attached to a joint (not shown) between two sections of casing 5. As used herein, the term joint also encompasses the bottom of the casing 5.

In another sub-aspect, before run in of casing 5, the diffuser shoe 35 is attached to the bottom side of the casing 5. Cement is then poured into the casing 5 to form the plug 40. The volume of the cement poured corresponds to the starting depth of the shallowest planned lateral wellbore, in this instance, lateral wellbore 15. To prevent the diffuser shoe 35 from being plugged with cement 40, a drillable cap (not shown) may be installed on the diffuser shoe 35. The pilot hole 45 is then drilled through the cement plug 40 to the diffuser shoe 35. The drillable cap is also drilled out opening a fluid path from the diffuser 35 through the pilot hole 45 and into the inside of the casing 5.

In yet another sub-aspect, the diffuser shoe 35 is attached to the bottom of the casing 5 with a drillable cap (not shown) to prevent plugging. The cement plug 40 will be formed after the diffuser shoe and the casing are run in to the wellbore 6.

After the diffuser shoe 35 is secured to the casing 5, an injection line 10 is connected to an outside of the diffuser shoe, preferably with a threaded connection (not shown). As shown with hidden lines, the diffuser shoe 35 is configured to provide a fluid passage between the injection line 10 and the pilot hole 45. Alternatively, the injection line 10 could be attached to a bottom side of the diffuser shoe 35. This alternative would allow for a simpler diffuser shoe to be used but would expose the injection line 10 to more risk of damage upon run in. Preferably, the injection line 10 is also secured to an outside of casing 5. The string of casing 5, with the injection line 10, is then run in from the surface to reinforce the main wellbore 6. The main wellbore 6 is cased down to a point below the starting depth of the deepest planned lateral wellbore, in this case, lateral wellbore 25. Preferably, at least a portion of the casing 5 corresponding to the starting depths of lateral wellbores 15, 25 is constructed of a drillable material, such as polyvinyl chloride (PVC), fiberglass, other composites, other plastics, aluminum, or a ferrous material. Other portions of the casing may be made from conventional, non-drillable material. The injection line 10 and the diffuser shoe 35 may also be constructed from a drillable material. After run-in, the casing 5 is secured to the main wellbore 6 with cement 4. By this process, the injection line 10 is also cemented in place outside the casing.

In the third sub-aspect, after cementing the outside of the casing 5, an inner side of the casing is then filled with cement to form the cement plug 40. The volume of the cement poured is selected so that a top of the plug 40 will correspond to the starting depth of the shallowest lateral wellbore to be drilled, in this instance, lateral wellbore 15. The pilot hole 45 is then drilled through the cement plug 40 with a straight drillstring (not shown) to the diffuser shoe 35. The drillable cap (not shown) is also drilled out opening a fluid path from the injection line 10, through the pilot hole 45, and into the inside of the casing 5.

A drillstring 20, preferably a coiled tubing drillstring, is then lowered into the main wellbore 6 to the top of plug 40. The drillstring 20 comprises a bent sub (not shown), a mud motor (not shown), an orienting device (not shown), and a drill bit 30. Since the top of plug 40 is substantially flat, the bent sub provides the bias so the drill bit 30 will drill down the intended path of the lateral wellbore 15 rather than through the cement plug 40. Plug 40 provides a starting surface for drill bit 30. The orienting device may be any of several known in the art, such as a gyroscope. The drill string 20 is then properly oriented and then drilling is begun. To begin drilling, a drilling fluid is pumped through the drillstring to the mud motor which provides rotary motion by converting energy from the drilling fluid. Preferably, for a coal bed methane formation 7, the drilling fluid is water. The drillstring 20 may be a more sophisticated configuration, for example, comprising a measurement while drilling apparatus and a steering motor which can change the direction of the bent sub while drilling.

Near the time drilling commences, a second fluid, having a density less than that of the drilling fluid, is injected through the line 10, the diffuser shoe 35, and the pilot hole 45 to the inside of casing 5. Preferably, the second fluid is a compressed gas, such as air, nitrogen, a mixture of air and nitrogen, or methane. The drilling fluid and the second fluid return to the surface via an annulus 9 defined by the inside of the casing 5 and an outside of the drillstring 20. The drilling fluid returns to the inside of casing 5 from the lateral wellbores 15, 25 via annuli defined by walls of the lateral wellbores 15, 25 and the outside of drillstring 20. The rate of second fluid injection corresponds to the rate of drilling fluid injected through the drill string 20 such that hydrostatic pressure exerted on the formation 7 by a column comprising a mixture of the drilling fluid and the second fluid may be controlled. Preferably, the hydrostatic pressure is maintained substantially at or below the fracture pressure of formation 7. More preferably, the hydrostatic pressure is maintained below the fracture pressure of formation 7 by a predetermined differential pressure. However, the hydrostatic pressure may also be maintained substantially above the fracture pressure of formation 7. The hydrostatic pressure may also be maintained substantially at or below the pore pressure of formation 7. The hydrostatic pressure may also be maintained according to any known managed pressure or underbalanced techniques.

Once the lateral wellbore 15 is completed, the drillstring 20 is removed. Alternatively, the drillstring 20 may be re-oriented and another lateral drilled at the same depth. A straight drillstring is then used to drill the plug 40 down to the location of the next planned lateral wellbore, in this case, lateral wellbore 25. The process is then repeated for each planned lateral wellbore. Once all of the lateral wellbores have been drilled, the plug 40 and the diffuser shoe 35 may be drilled out to restore access a lower end of main wellbore 6, below the diffuser shoe 35.

Figure 2:
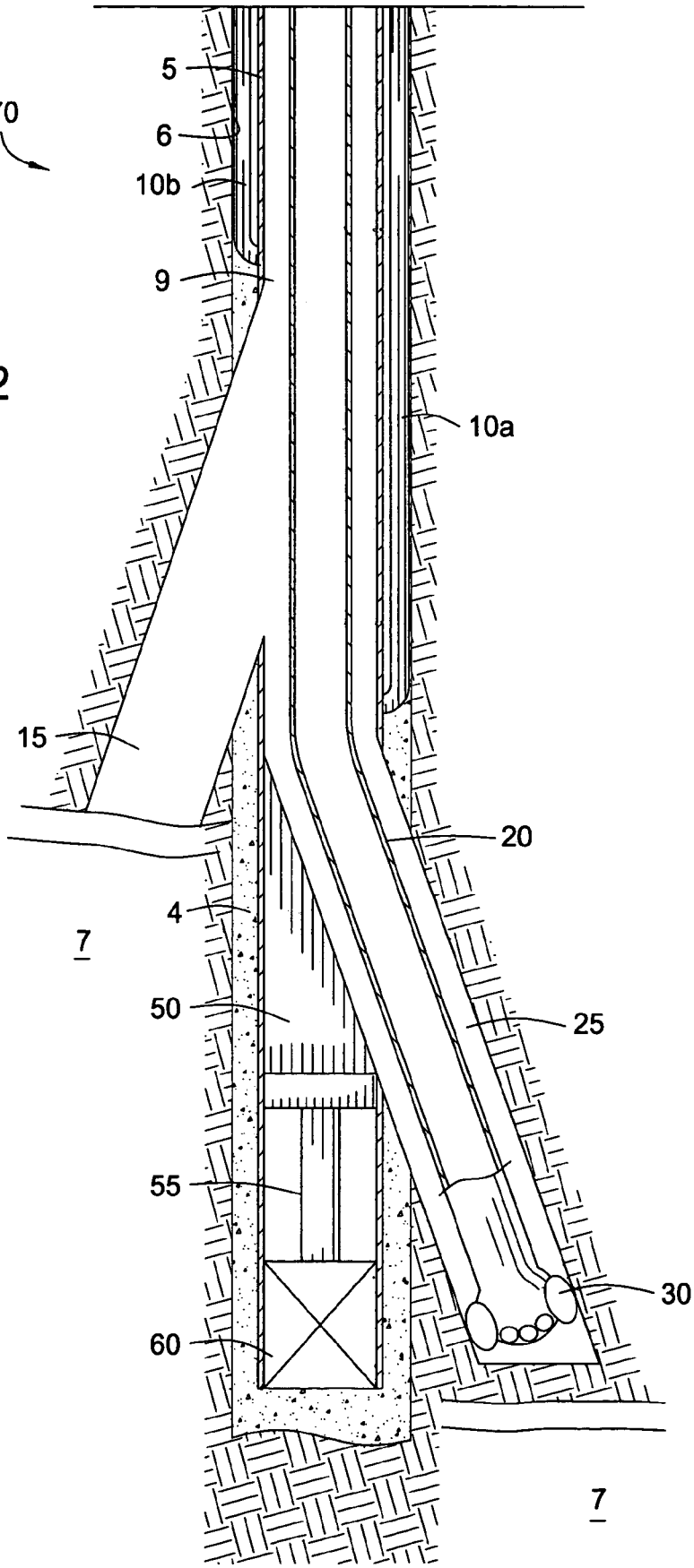
FIG. 2 is sectional view of a multilateral well showing a portion of a drilled lateral wellbore and a second lateral wellbore in the process of being drilled with a drilling technique according to another aspect of the present invention.

FIG. 2 is sectional view of a multilateral well 70 showing a portion of a drilled lateral wellbore 15 and a second lateral wellbore 25 in the process of being drilled with a drilling technique according to another aspect of the present invention. The well 70 shown in FIG. 2 may be created in the following manner. The main wellbore 6 is drilled from the surface (not shown) below a starting depth of the deepest planned lateral wellbore, in this case lateral 25. A string of casing 5 is then run in from the surface to reinforce the main wellbore 6. Preferably, the main wellbore 6 is cased down to a point below the starting depth of the deepest planned lateral wellbore, in this case, lateral wellbore 25. However, the casing 5 may extend past packer 60. The casing 5 is run in with injection lines 10*a,b* secured to an outer side of the casing 5.

In contrast to the aspect discussed with FIG. 1, a diffuser shoe is not used so the injection lines 10*a,b* are connected to ports (not shown) disposed in a wall of casing 5. Two lines 10*a,b* are used to help compensate for the lack of diffuser shoe 35. However, only one injection line 10 may be used, if desired. After run-in, the casing 5 is secured to the main wellbore 6 with cement 4. By this process, injection lines 10*a,b* are also cemented in place outside the casing 5. Lines 10*a,b* are placed along the casing 5 so as to avoid obstructing the drilling paths for lateral wellbores 15,25.

After cementing the outside of casing 5, an inflatable packer 60 is lowered in on a workstring (not shown), comprising an orienting member. The packer 60 was oriented to a known orientation and set. The packer comprises a mating feature, such as a key or keyway. A retrievable deflector device 50, such as a whipstock, and a stem 55 are then run-in to the packer 60. The whipstock 50 and stem 55 are coupled together, for example, with a threaded connection. The stem 55 comprises a corresponding mating feature (not shown) so that it may only be seated in packer 60 in a single known orientation. This way the orientation of the whipstock 50 is known and controlled. The length of the stem 55 will correspond to the starting depth of the lateral wellbore to be drilled, in this instance lateral 15.

A drillstring 20 is then lowered into the main wellbore 6 to a top end of whipstock 50. The drillstring comprises the mud motor and the drill bit 30. Since the whipstock 50 is ramped, it provides the bias so the drill bit 30 will drill down the intended path of the lateral wellbore 15, thereby eliminating the need for the bent sub. Also, since the orientation of the whipstock is known and fixed, no orientation device is needed in the drillstring. Drilling of lateral wellbore 15 may then be commenced. Again, the second fluid is injected through lines 10*a,b* during drilling to control the hydrostatic pressure of the column of returning drill fluid.

Once drilling of lateral wellbore 15 is completed, the drillstring 20 is removed. A workstring is then run in to retrieve whipstock 50 and stem 55. At the surface, stem 55 is replaced with another stem 55 with the proper length and orientation for lateral wellbore 25. The whipstock 50 may also be replaced. The whipstock 50 and stem 55 are then run in and set in packer 60. Lateral wellbore 25 may then be drilled as shown.

Figure 3:
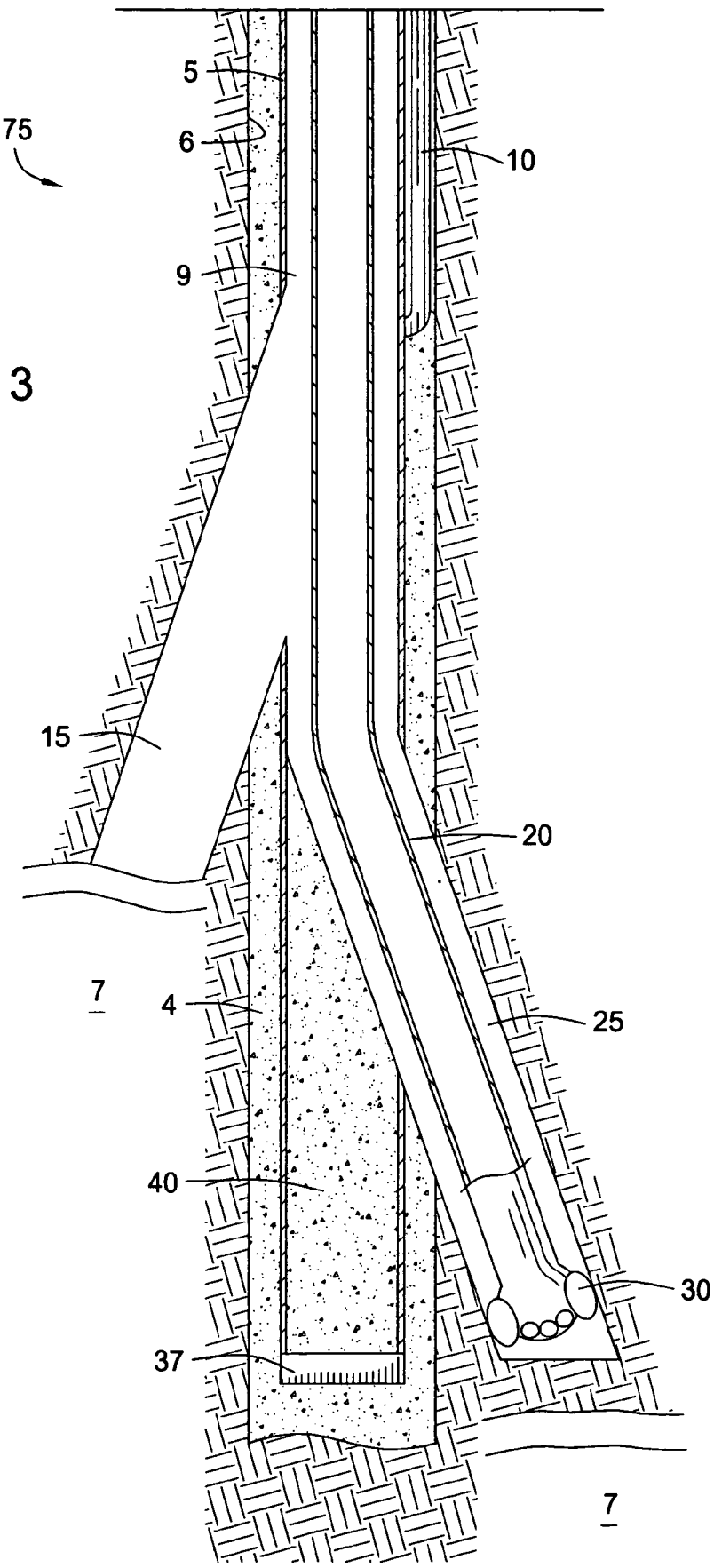
FIG. 3 is a sectional view of a multilateral well showing a portion of a drilled lateral wellbore and a second lateral wellbore in the process of being drilled with a drilling technique according to another aspect of the present invention.

FIG. 3 is a sectional view of a multilateral well 75 showing a portion of a drilled lateral wellbore 15 and a second lateral wellbore 25 in the process of being drilled with a drilling technique according to another aspect of the present invention. Since this aspect of the invention is similar to that discussed with FIG. 1, only the differences will be discussed. Any of the sub-aspects discussed with FIG. 1 may be used. Contrary to the first aspect, the injection line is connected to a port (not shown) disposed through a wall of the casing 5 instead of to the diffuser 35. In this aspect, a solid shoe 37 is used instead of the diffuser shoe 35 and the plug 40 is solid. Preferably, the line 10 is connected to the casing 5 at a point above the upper lateral 15, however, it may be connected anywhere along the casing 5 in the vicinity of the laterals 15,25 to be drilled.

Figure 4:
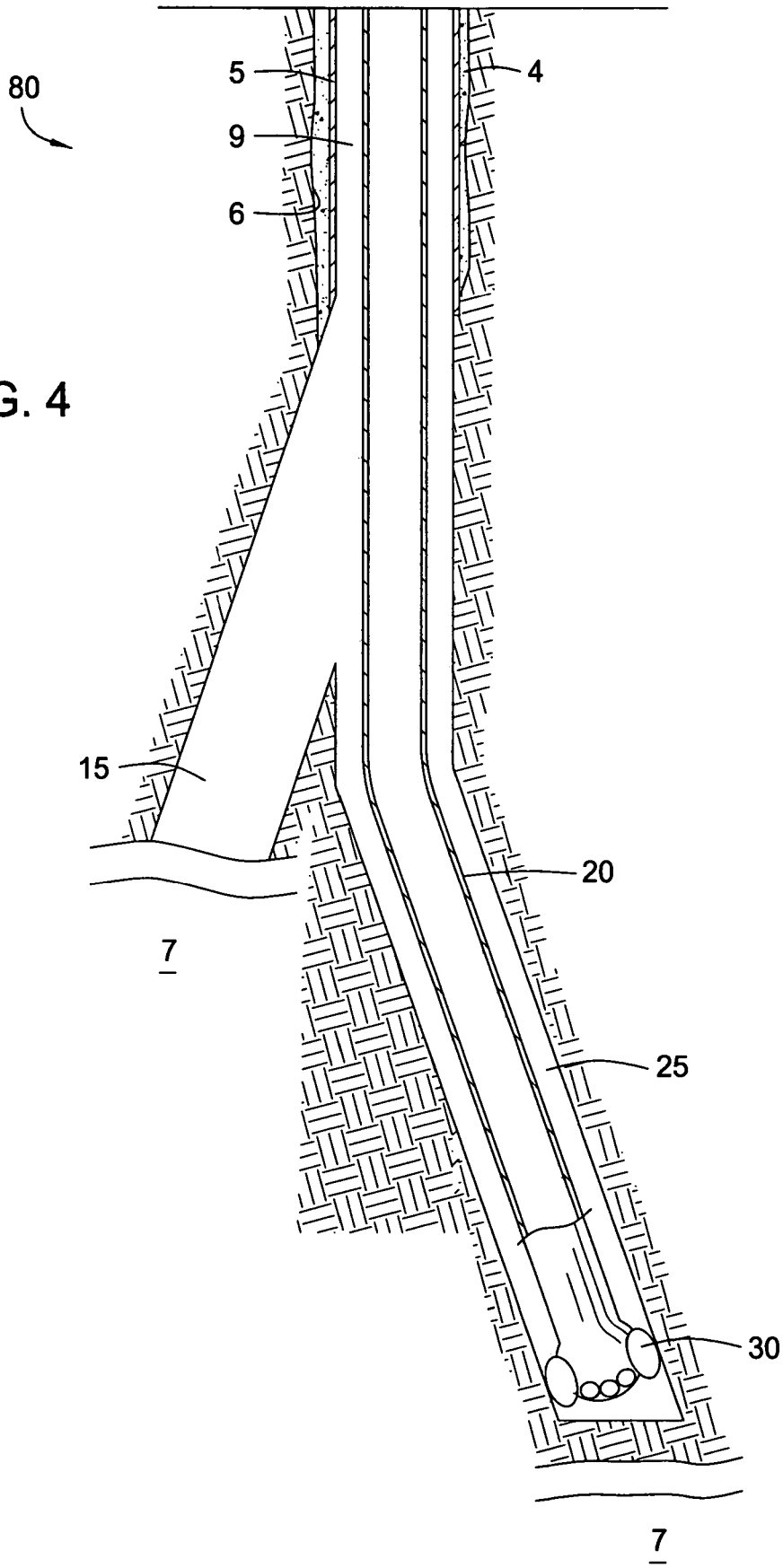
FIG. 4 is a sectional view of a multilateral well showing a portion of a drilled lateral wellbore and a second lateral wellbore in the process of being drilled with a drilling technique according to another aspect of the present invention.

FIG. 4 is a sectional view of a multilateral well 80 showing a portion of a drilled lateral wellbore 15 and a second lateral wellbore 25 in the process of being drilled with a drilling technique according to another aspect of the present invention. The well 80 shown in FIG. 4 may be created in the following manner. The main wellbore 6 is drilled from the surface (not shown) to the staring depth of the shallowest planned lateral wellbore, in this case lateral 15. A string of casing 5 is then run in from the surface to reinforce the main wellbore 6. The main wellbore 6 is cased down to the staring depth of the shallowest planned lateral wellbore, in this case, lateral 15. After run-in, the casing 5 is secured to the main wellbore 6 with cement 4.

The drillstring 20 is then lowered into the main wellbore 6 to the starting depth of the shallowest planned lateral wellbore, in this case lateral 15. The drillstring comprises a bent sub (not shown), a mud motor (not shown), an orienting device (not shown), and a drill bit 30. The drill string 20 is then properly oriented and then drilling is begun. Instead of injecting the second fluid through the injection line secured to the outside of the casing 5, as in previous aspects, the second fluid and the drilling fluid are pumped into the drillstring 20 simultaneously to control the hydrostatic pressure of the return column during drilling of the lateral 15. Note, in this aspect the bottom of the wellbore 6 replaces the plug 40 of previous aspects. Once lateral 15 is completed, drillstring 20 is removed and a straight drillstring (not shown) is used to extend main wellbore 6 to the starting depth of lateral 25 and the process repeated as shown.

Figure 5:
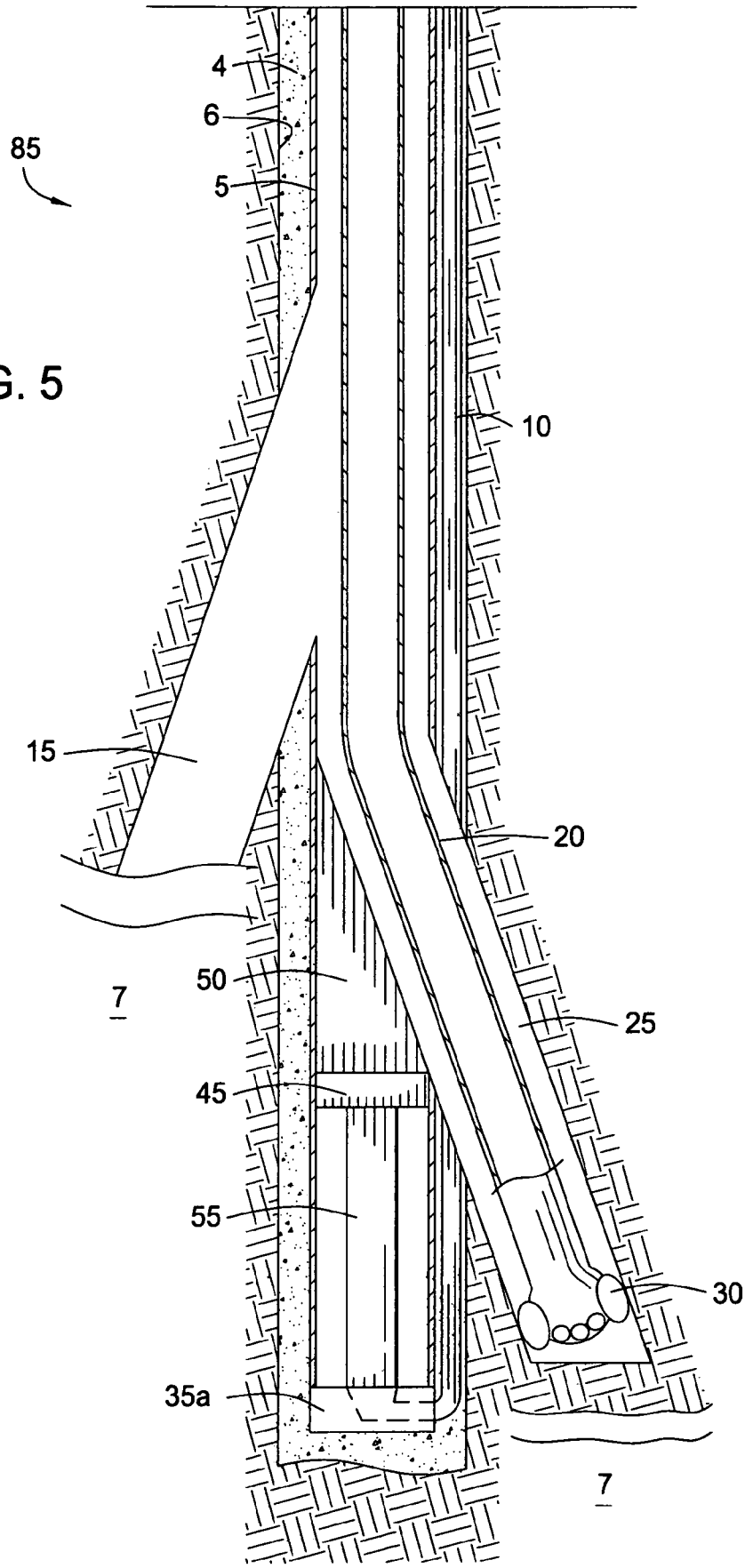
FIG. 5 is a sectional view of a multilateral well showing a portion of a drilled lateral wellbore and a second lateral wellbore in the process of being drilled with a drilling technique according to another aspect of the present invention.

FIG. 5 is a sectional view of a multilateral well 85 showing a portion of a drilled lateral wellbore 15 and a second lateral wellbore 25 in the process of being drilled with a drilling technique according to another aspect of the present invention. The well 85 shown in FIG. 5 may be created in the following manner. The main wellbore 6 is drilled from the surface below the staring depth of the deepest planned lateral wellbore, in this case lateral 25. A retrievable deflector device 50, such as a whipstock, and a stem 55 are then seated on a diffuser shoe 35*a*. The diffuser shoe 35*a* may comprise a mating feature, such as a key or keyway (not shown). The whipstock 50 and stem 55 are coupled together, for example, with a threaded connection. Both the whipstock 50 and the stem 55 comprise flow bores therethrough. The stem 55 comprises a corresponding mating feature (not shown) so that it may only be seated in diffuser shoe 35*a* in a single known orientation. This way the orientation of the whipstock 50 is known and controlled. The length and orientation of the stem 55 will correspond to the starting depth and direction of the shallowest planned lateral wellbore, in this instance lateral 15. The diffuser shoe 35*a* is then attached to the bottom of casing string 5. Injection line 10 is then attached to the outside of diffuser shoe 35*a*. Alternatively, the injection line 10 may be attached to the bottom of diffuser shoe 35*a*, as discussed previously in the aspect discussed with FIG. 1.

The string of casing 5 and injection line 10 are then run in from the surface. The main wellbore 6 is cased down to a point below the deepest planned lateral wellbore, in this case lateral 25. After run-in, the casing 5 is secured to the main wellbore 6 with cement 4. By this process, the injection line 10 is also cemented in place outside the casing.

A drillstring 20 is then lowered into the main wellbore 6 to a top end of whipstock 50. The drillstring comprises the mud motor and the drill bit 30. Since the whipstock 50 is ramped, it provides the bias so the drill bit 30 will drill down the intended path of the lateral wellbore 15, thereby eliminating the need for the bent sub. Also, since the orientation of the whipstock is known and fixed, no orientation device is needed in the drillstring. Drilling of lateral wellbore 15 may then be commenced. Again, the second fluid is injected through line 10 to control the hydrostatic pressure of the column of returning drill fluid.

Once drilling of lateral wellbore 15 is completed, the drillstring 20 is removed. A workstring is then run in to retrieve whipstock 50 and stem 55. At the surface, stem 55 is replaced with another stem 55 with the proper length and orientation for lateral wellbore 25. The whipstock 50 may also be replaced. The whipstock 50 and stem 55 are then run in and set in diffuser shoe 35*a*. Lateral wellbore 25 may then be drilled as shown.

In another aspect (not shown) of the present invention, aspects discussed with FIGS. 1–3 and 5 are modified by omitting the injection line(s) 10 and pumping the second fluid and the drilling fluid simultaneously into the drillstring 20 to control hydrostatic pressure during drilling of the laterals 15,25 as in the aspect discussed with FIG. 4. The solid shoe 37 may also replace the diffuser shoe 35.

In another aspect (not shown) of the present invention, the aspect discussed with FIG. 4 is used to drill a main wellbore, i.e. wellbore 6 in FIG. 4, to a location corresponding to a starting depth of a first lateral, i.e. the lateral 15 in FIG. 4. A first string of casing, i.e. casing 5 in FIG. 4, is then run into the main wellbore. The first lateral is drilled according to the aspect discussed with FIG. 4. A straight drillstring is then used to extend the main wellbore to a location below a starting depth of a planned second lateral, i.e. lateral 25 in FIG. 4. A shoe, i.e. shoe 37 in FIG. 3, and a plug, i.e. plug 40 in FIG. 3, are connected to a joint of a second string of casing. The plug may be preformed or formed within the second string of casing as in the aspects discussed with FIGS. 1 and 3. Alternatively, a deflector device and deflector stem, i.e. device 50 and stem 55 in FIGS. 2 and 5, may be used instead of the plug. The length of the plug or deflector stem is configured to correspond to the starting depth of the second lateral. The second string of casing is sized to fit within the first string of casing, i.e. casing 5 of FIG. 4. A portion of the second string of casing, corresponding to the starting depth of the second lateral, is made from a drillable material. The second string of casing is run in through the first string of casing to reinforce the extended section of the main wellbore and an upper end of the second string of casing is coupled to a lower end of the first string of casing in a known manner. Consequently, the second string of casing will block access to the first lateral. Access may be restored by any of a number of known methods including drilling and perforating. Alternatively, the second string of casing may not be coupled to the first string, instead, it may be seated on a bottom end of the main wellbore extension. Seating the second string of casing on the bottom of the wellbore instead of coupling the second string to the first string of casing will not result in blockage of the first lateral. The second lateral is then drilled using the plug or deflector device as discussed in previous aspects, however, the second fluid is injected through the drillstring to control the hydrostatic pressure of the column of returning drill fluid, as in the aspect discussed with FIG. 4.

In any of the preferred aspects discussed above, the laterals 15,25 may be cased or have production tubing disposed therein by any number of known methods. The casing may even be cemented in place. Junctions between the laterals 15,25 and the main wellbore 6 may also be reinforced by any number of known methods. In the art, these methods are commonly known as levels of completion, i.e. levels one to five. Completion up to any of these known levels would be possible.

In any of the preferred aspects discussed above, expandable tubing or casing may be used instead of casing 5 and even to complete the laterals 15,25 and the junctions between the laterals and the main wellbore 6.

Any of the preferred aspects discussed above may be used for land-based or offshore wells.

While the foregoing is directed to embodiments of the present invention, other and further embodiments of the invention may be devised without departing from the basic scope thereof, and the scope thereof is determined by the claims that follow.

The invention claimed is:

1. A method for drilling a lateral wellbore from a main wellbore, comprising:

running a string of casing with an injection line connected thereto into the main wellbore, wherein the injection line is disposed along an outer side of the casing and a portion of the casing corresponding to a starting depth of the lateral wellbore is made from a drillable material;

running a drillstring through the casing to the starting depth of the lateral wellbore, wherein the drillstring comprises a drill bit;

injecting drilling fluid through the drill sting; and injecting a second fluid, having a density less than that of the drilling fluid, through the injection line at a rate corresponding to an injection rate of the drilling fluid to control hydrostatic pressure exerted by a column of the drilling fluid and the second fluid returning through the casing.

2. The method of claim 1, further comprising:

connecting a shoe to a joint of the casing; and pouring a volume of cement into the casing to form a plug, wherein the volume is selected so that a top of the plug will correspond to the starting depth.

3. The method of claim 2, further comprising:

drilling a pilot hole through the cement plug to the shoe.

4. The method of claim 3, further comprising:

installing a drillable cap on the shoe.

5. The method of claim 4, further comprising;

drilling the drillable cap to form a fluid path from the shoe through the pilot hole into the casing.

6. The method of claim 2, further comprising:

drilling the plug down so that a top of the plug corresponds to a starting depth of a second lateral wellbore.

7. The method of claim 2, wherein the shoe is constructed of a drillable material.

8. The method of claim 2, wherein the shoe is connected to the bottom of the casing.

9. The method of claim 2, further comprising:

connecting the injection line to the bottom of the shoe.

10. The method of claim 1, further comprising:

connecting a diffuser shoe to a joint of the casing; and connecting the injection line to the diffuser shoe.

11. The method of claim 10, wherein the injection line is connected to an outside of the diffuser shoe; and wherein the diffuser shoe is configured to provide a fluid passage between the injection line and the pilot hole.

12. The method of claim 10, wherein the injection line is connected to a bottom side of the diffuser shoe; and wherein the diffuser shoe is configured to provide a fluid passage between the injection line and the pilot hole.

13. The method of claim 10, further comprising:

securing the injection line outside the casing.

14. The method of claim 1, further comprising:

inserting a drillable plug into the casing, wherein the length of the plug is configured so that a top of the plug corresponds to the starting depth; and connecting a shoe to a joint of the casing.

15. The method of claim 14, further comprising:

drilling the plug down so that a top of the plug corresponds to a starting depth of a second lateral wellbore.

16. The method of claim 1, further comprising:

running a workstring into the main wellbore to a location below the starting depth, wherein the workstring comprises: a deflector device, a deflector stem, and an inflatable packer and the length of the deflector stem is configured so that the deflector device corresponds to the starting depth;

orienting the packer so that the deflector device corresponds to a starting orientation of the lateral wellbore; and setting the packer.

17. The method of claim 16, further comprising:

retrieving the deflector device and the deflector stem from the packer;

coupling a second deflector stem to the deflector device, wherein the length of the second stem is configured so that a top of the second stem corresponds to a starting depth of a second lateral wellbore;

running a workstring into the main wellbore, comprising the deflector device and the second deflector stem; and seating the deflector stem into the packer.

18. The method of claim 1, further comprising:

seating a deflector stem and a deflector device on a diffuser shoe, wherein the length of the stem is configured so that a top of the stem corresponds to the starting depth;

connecting the diffuser shoe to a joint of the casing, so that the length and orientation of the deflector device corresponds to the starting depth and a starting orientation of the lateral wellbore; and connecting the injection line to the diffuser shoe.

19. The method of claim 18, further comprising:

retrieving the deflector device and the deflector stem from the diffuser shoe;

coupling a second deflector stem to the deflector device, wherein the length of the second stem is configured so that a top of the second stem corresponds to a starting depth of a second lateral wellbore;

running a workstring into the main wellbore, comprising the deflector device and the second deflector stem; and seating the deflector stem into the diffuser shoe.

20. The method of claim 1, wherein the hydrostatic pressure is maintained substantially at or below a fracture pressure of a formation being drilled to.

21. The method of claim 1, wherein the hydrostatic pressure is maintained below a fracture pressure of a formation being drilled to by a predetermined differential pressure.

22. The method of claim 1, wherein the hydrostatic pressure is maintained substantially above a fracture pressure of a formation being drilled to.

23. The method of claim 1, wherein the hydrostatic pressure is maintained substantially at or below the pore pressure of a formation being drilled to.

24. The method of claim 1, wherein the Injection line is constructed of a drillable material.

25. The method of claim 1. further comprising:

connecting the injection line to a port formed through the wall of the casing.

26. The method of claim 1, further comprising:

drilling through a wall of the casing with the drill bit.

27. The method of claim 1, further comprising:

cementing the casing to the main wellbore.

28. The method of claim 1, further comprising:

drilling the lateral wellbore from the main wellbore to a formation of interest.

29. The method of claim 28, wherein the formation of interest is a coal bed methane formation.

30. A method for drilling a lateral wellbore from a main wellbore, comprising:

running a string of casing into the main wellbore, wherein a portion of the casing corresponding to a starting depth of the lateral wellbore is made from a drillable material;

running a drillstring through the casing to the starting depth of the lateral wellbore, wherein the drillstring comprises a drill bit; and injecting a drilling fluid and a second fluid, having a density less than that of the drilling fluid, only through the drillstring, wherein an injection rate of the second fluid corresponds to an injection rate of the drilling fluid to control hydrostatic pressure exerted by a column of the drilling fluid and the second fluid returning through the casing.

31. The method of claim 30, further comprising:

drilling the main wellbore to the starting depth of the lateral wellbore.

32. The method of claim 31, further comprising:

removing the drillstring;

drilling the main wellbore to a starting depth of a second lateral wellbore; and running the drillstring into the main wellbore to the starting depth of the second lateral wellbore.

33. The method of claim 30, further comprising:

connecting a shoe to a joint of the casing; and pouring a volume of cement into the casing to form a plug, wherein the volume is selected so that a top of the plug will correspond to the starting depth.

34. The method of claim 33, further comprising:

drilling a pilot hole through the cement plug to the shoe.

35. The method of claim 33, further comprising:

drilling the plug down so that a top of the plug corresponds to a starting depth of a second lateral wellbore.

36. The method of claim 30, further comprising:

connecting a shoe to a joint of the casing.

37. The method of claim 30, further comprising:

inserting a drillable plug into the casing, wherein the length of the plug is configured so that a top of the plug corresponds to the starting depth; and connecting a shoe to a joint of the casing.

38. The method of claim 37, further comprising:

drilling the plug down so that a top of the plug corresponds to a starting depth of a second lateral wellbore.

39. The method of claim 30, further comprising:

running a workstring into the main wellbore to a location below the starting depth, wherein the workstring comprises: a deflector device, a deflector stem, and an inflatable packer;

orienting the packer so that the deflector device corresponds to the starting depth and a starting orientation of the lateral wellbore; and setting the packer.

40. The method of claim 39, further comprising:

retrieving the deflector device and the deflector stem from the packer;

coupling a second deflector stem to the deflector device, wherein the length of the second stem is configured so that a top of the second stem corresponds to a starting depth of a second lateral wellbore;

running a workstring into the main wellbore, comprising the deflector device and the second deflector stem; and seating the deflector stem into the packer.

41. The method of claim 30, further comprising:

seating a deflector stem and a deflector device on a shoe, wherein the length of the stem is configured so that a top of the stem corresponds to the starting depth; and connecting the shoe to a joint of the casing, so that the length and orientation of the deflector device corresponds to the starting depth and a starting orientation of the lateral wellbore.

42. The method of claim 41, further comprising:

retrieving the deflector device and the deflector stem from the shoe;

coupling a second deflector stem to the deflector device, wherein the length of the second stem is configured so that a top of the second stem corresponds to a starting depth of a second lateral wellbore;

running a workstring into the main wellbore, comprising the deflector device and the second deflector stem; and seating the deflector stem into the shoe.

43. The method of claim 30, wherein the hydrostatic pressure is maintained substantially at or below a fracture pressure of a formation being drilled to.

44. The method of claim 30, wherein the hydrostatic pressure is maintained below a fracture pressure of a formation being drilled to by a predetermined differential pressure.

45. The method of claim 30, wherein the hydrostatic pressure is maintained substantially above a fracture pressure of a formation being drilled to.

46. The method of claim 30, further comprising:

cementing the casing to the main wellbore.

47. The method of claim 30, further comprising:

drilling the lateral wellbore from the main wellbore to a formation of interest.

48. The method of claim 47, wherein the formation of interest is a coal bed methane formation.

49. A method for drilling a lateral wellbore from a main wellbore, comprising:

running a string of casing into the main wellbore, wherein a portion of the casing corresponding to a starting depth of the lateral wellbore is made from a drillable material;

running a drillstring through the casing to the starting depth of the lateral wellbore, wherein the drillstring comprises a drill bit;

injecting a drilling fluid and a second fluid, having a density less than that of the drilling fluid, through the drillstring, wherein an injection rate of the second fluid corresponds to an injection rate of the drilling fluid to control hydrostatic pressure exerted by a column of the drilling fluid and the second fluid returning through the casing;

connecting a shoe to a joint of the casing; and pouring a volume of cement into the casing to form a plug, wherein the volume is selected so that a top of the plug will correspond to the starting depth.

50. The method of claim 49, further comprising:

drilling a pilot hole through the cement plug to the shoe.

51. The method of claim 49, further comprising:

drilling the plug down so that a top of the plug corresponds to a starting depth of a second lateral wellbore.

52. A method for drilling a lateral wellbore from a main wellbore, comprising:

running a string of casing into the main wellbore, wherein a portion of the casing corresponding to a starting depth of the lateral wellbore is made from a drillable material;

running a drilletring through the casing to the starting depth of the lateral wellbore, wherein the drillstring comprises a drill bit;

injecting a drilling fluid and a second fluid, having a density less than that of the drilling fluid, through the drillstring, wherein an injection rate of the second fluid corresponds to an injection rate of the drilling fluid to control hydrostatic pressure exerted by a column of the drilling fluid and the second fluid returning through the casing;

inserting a drillable plug into the casing, wherein the length of the plug is configured so that a top of the plug corresponds to the starting depth; and connecting a shoe to a joint of the casing.

53. The method of claim 52, further comprising:

drilling the plug down so that a top of the plug corresponds to a starting depth of a second lateral wellbore.

54. A method for drilling a lateral wellbore from a main wellbore, comprising:

running a string of casing into the main wellbore, wherein a portion of the casing corresponding to a starting depth of the lateral wellbore is made from a drillable material;

running a drillstring through the casing to the starting depth of the lateral wellbore, wherein the drillstring comprises a drill bit;

injecting a drilling fluid and a second fluid, having a density less than that of the drilling fluid, through the drillstring, wherein an injection rate of the second fluid corresponds to an injection rate of the drilling fluid to control hydrostatic pressure exerted by a column of the drilling fluid and the second fluid returning through the casing;

seating a deflector stem and a deflector device on a shoe, wherein the length of the stem is configured so that a top of the stem corresponds to the starting depth; and connecting the shoe to a joint of the casing, so that the length and orientation of the deflector device corresponds to the starting depth and a starting orientation of the lateral wellbore.

55. The method of claim 54, further comprising:

retrieving the deflector device and the deflector stem from the shoe;

coupling a second deflector stem to the deflector device, wherein the length of the second stem is configured so that a top of the second stem corresponds to a starting depth of a second lateral wellbore;

running a workstring into the main wellbore, comprising the deflector device and the second deflector stem; and seating the deflector stem into the shoe.

* * * * *